United States Patent [19]

Oldham

[11] Patent Number: 4,749,102

[45] Date of Patent: Jun. 7, 1988

[54] HAZARDOUS LIQUID STORAGE CONTAINER

[76] Inventor: Millard L. Oldham, 6614 Langdale Cv., Memphis, Tenn. 38119

[21] Appl. No.: 101,774

[22] Filed: Sep. 28, 1987

[51] Int. Cl.[4] ..... B65D 53/00

[52] U.S. Cl. ..... 220/344; 220/20

[58] Field of Search ..... 220/1.5, 20, 344

[56] References Cited

U.S. PATENT DOCUMENTS

| | | | |
|---|---|---|---|
| 2,206,848 | 7/1940 | McAvoy | 220/344 |
| 2,510,643 | 6/1950 | Liong | 220/344 |
| 2,510,671 | 6/1950 | Verheyden | 220/344 |
| 2,969,891 | 1/1961 | Presnick | 220/344 |

*Primary Examiner*—George T. Hall

*Attorney, Agent, or Firm*—Walker & McKenzie

[57] ABSTRACT

An apparatus for safely storing one or more containers of hazardous liquids and the like. The apparatus includes a receptacle including a front wall, a rear wall, end walls and a bottom joined to one another in a liquid tight manner and having an open top; a lid movably attached to the body for movement between a closed position in which the open top of the receptacle is blocked and an open position; and lock structure coupled to the receptacle for locking the lid in the closed position, the lock structure including a first hook member and a second hook member with one of the hook members attached to the lid and with the other of the hook members attached to the receptacle, the first hook member being movable between a locked position in which the second hook member is caught by the first hook member to lock the lid in the closed position and an unlocked position.

21 Claims, 3 Drawing Sheets

HAZARDOUS LIQUID STORAGE CONTAINER

BACKGROUND OF THE INVENTION

1. Field of the Invention

The present invention relates, in general, to a storage apparatus for reducing the hazards of transporting hazardous liquids in pickup trucks and the like.

2. Description of the Related Art

Many hazardous liquids, such as chemicals used by pest control personnel, are packaged in relatively small containers, such as five gallon cans, one gallon cans, bottles, etc., for transport and use at a job site. The prevalent practice in the pest control field is to merely store such hazardous chemical containers in open top boxes in the back of service vehicles, such as pickup trucks and the like, for transport to a job site.

A preliminary patentabilty search disclosed the following patents: Kappen, U.S. Pat. No. 2,947,436; Combs et al, U.S. Pat. No. 3,044,656; Morrison, U.S. Pat. No. 3,115,982; Underwood et al, U.S. Pat. No. 3,754,803; Kolchev, U.S. Pat. No. 3,854,544; and Hlinsky et al, U.S. Pat. No. 4,626,155. None of the above patents disclose or suggest the present invention.

SUMMARY OF THE INVENTION

The present invention is directed toward providing an apparatus for allowing relatively small containers of hazardous liquids to be stored and safetly transported in service vehicles, such as pickup trucks and the like, to job sites.

The apparatus of the present invention includes a receptacle including a front wall, a rear wall, end walls and a bottom joined to one another in a liquid tight manner and having an open top; a lid movably attached to the body for movement between a closed position in which the open top of the receptacle is blocked and an open position; and lock means coupled to the receptacle for locking the lid in the closed position, the lock means including a first hook member and a second hook member with one of the hook members attached to the lid and with the other of the hook members attached to the receptacle, the first hook member being movable between a locked position in which the second hook member is caught by the first hook member to lock the lid in the closed position and an unlocked position.

DESCRIPTION OF THE PREFERRED EMBODIMENT

Figure 1:
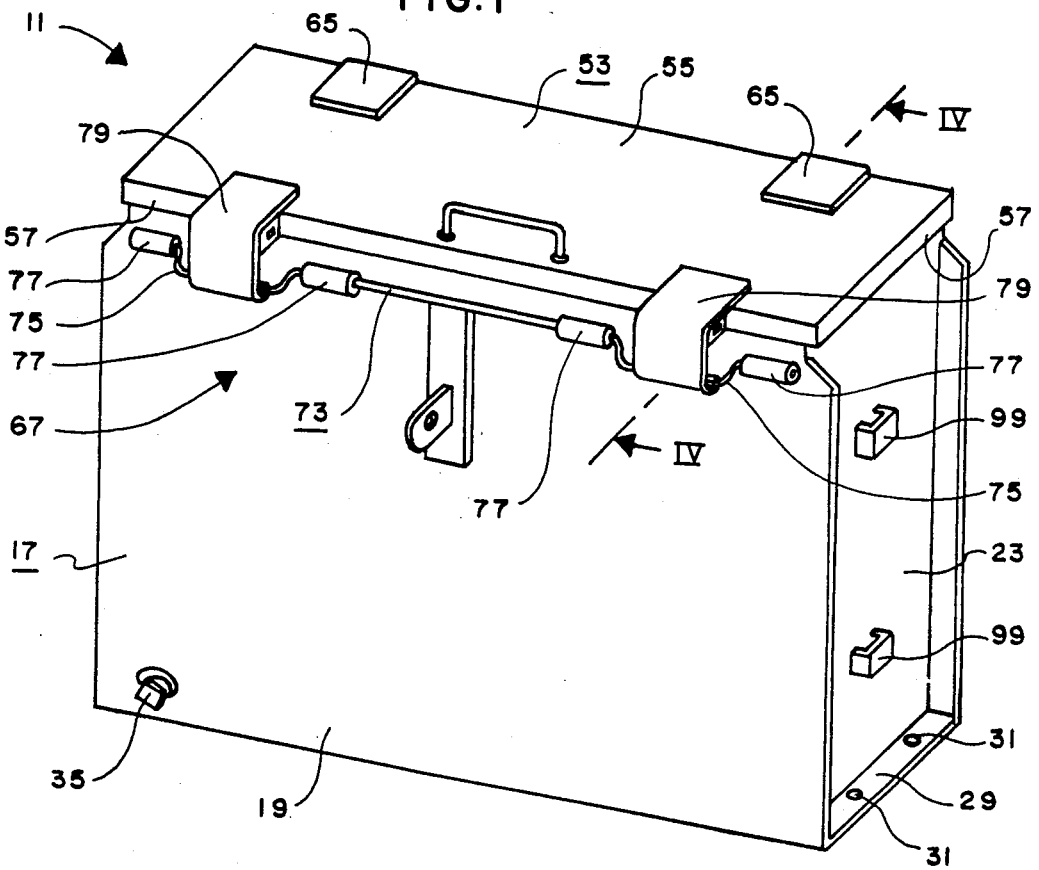
FIG. 1 is a perspective view of the apparatus of the present invention.
Figure 2:
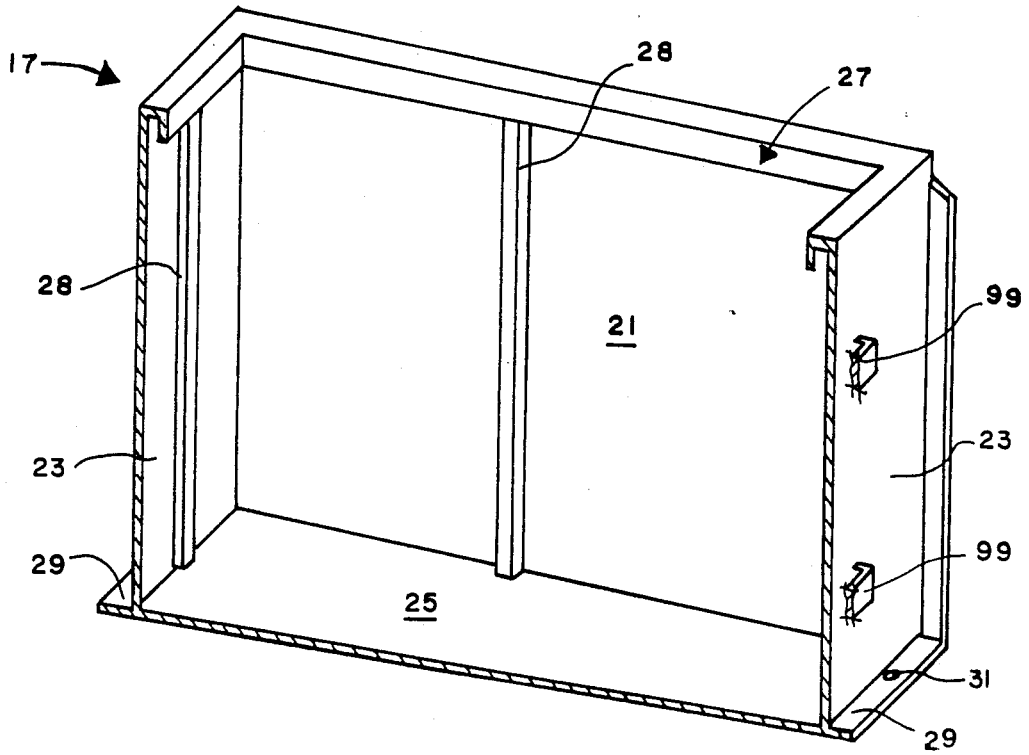
FIG. 2 is a perspective view of the outer receptacle of the apparatus of the present invention with a portion thereof broken away.
Figure 3:
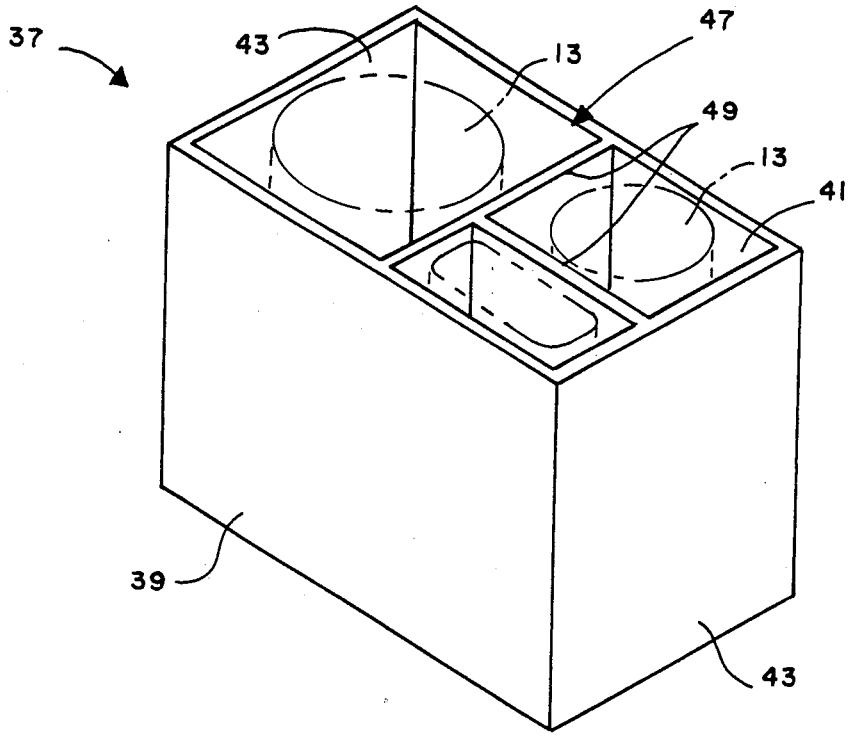
FIG. 3 is a perspective view of the inner receptacle of the apparatus of the present invention with a plurality of containers shown therein in broken lines.
Figure 4:
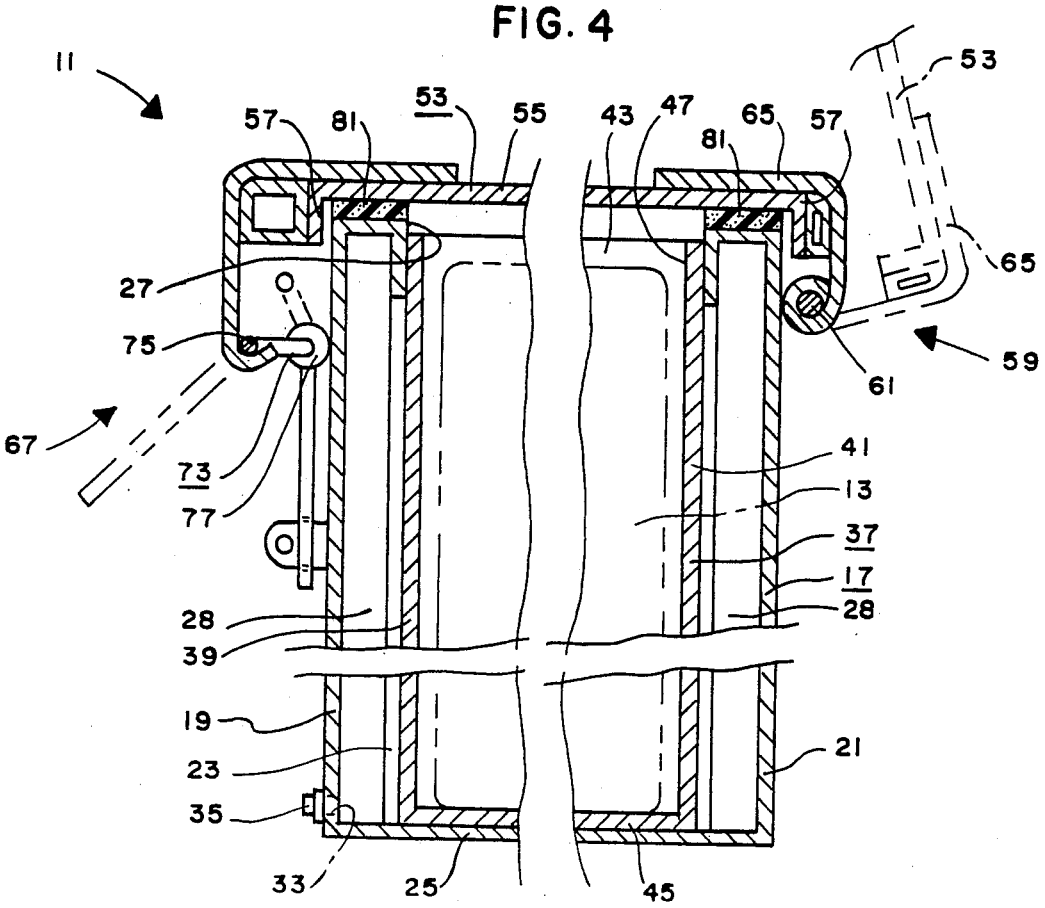
FIG. 4 is a sectional view substantially as taken on line IV—IV of FIG. 1 with certain components shown in moved positions in broken lines.
Figure 5:
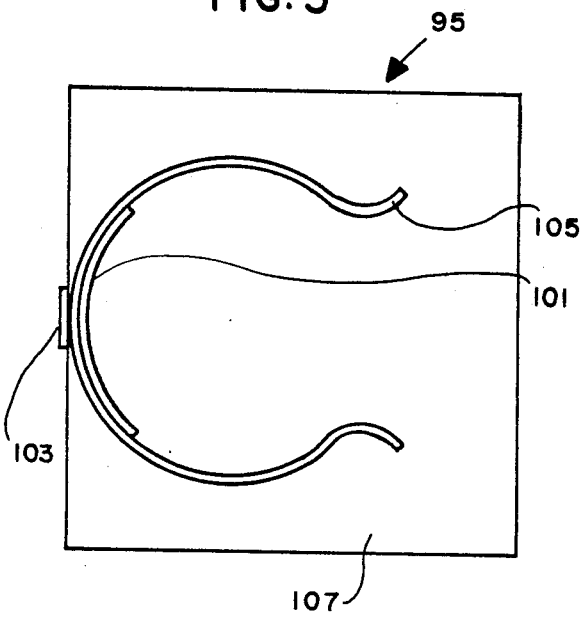
FIG. 5 is a top plan view of the outrigger attachment means of the apparatus of the present invention.
Figure 6:
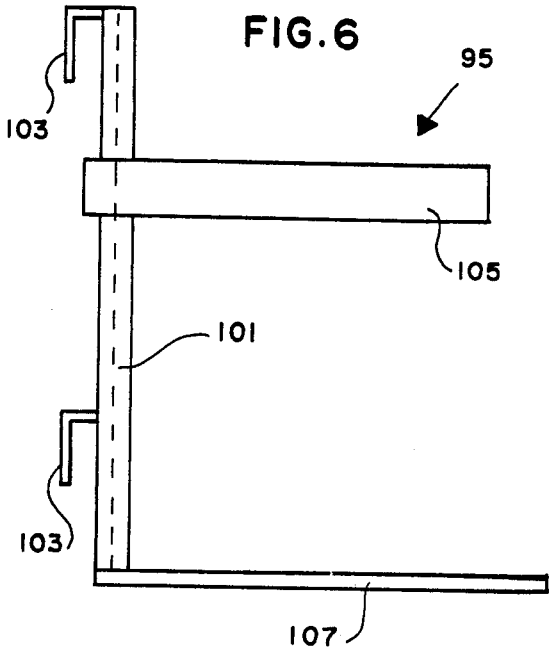
FIG. 6 is a side elevational view of the outrigger attachment means of FIG. 5.
Figure 7:
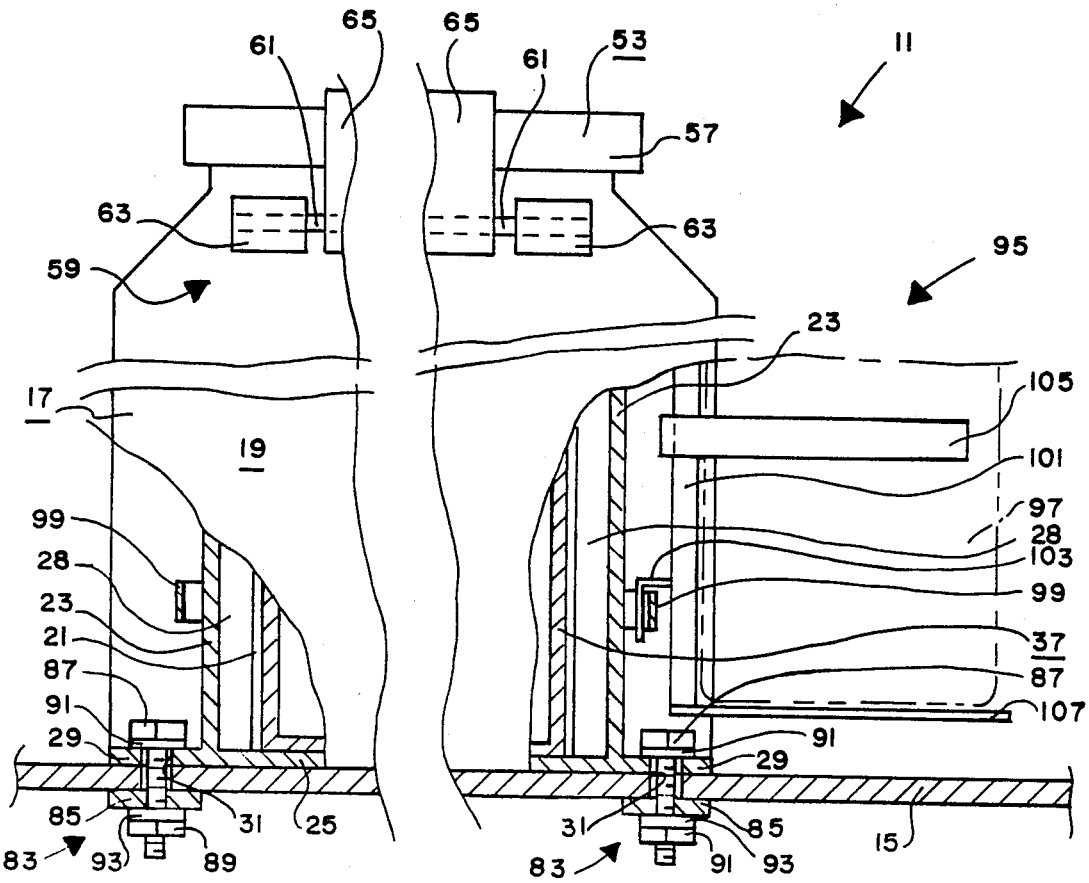
FIG. 7 is a side elevational view of the apparatus of the present invention shown attached to a support structure with portions thereof broken away for clarity and with a sprayer shown attached to the outrigger attachment means in broken lines.

The preferred embodiment of the apparatus 11 is for use by pest control personnel, and the like, to safely store one or more relatively small containers 13 of hazardous liquids and the like (e.g., pest control chemicals) in a vehicle, such as a pick-up truck, as the vehicle is driven to a job site or the like. The apparatus 11 is designed to be fixedly attached to a support member or structure 15 such as the bed of a pick-up truck or the like. However, even though the present invention will be herein described and illustrated with respect to a perferred embodiment and a preferred use therefore, it is not to be so limited since modifications and changes can be made therein which are within the full intended scope of the invention.

The apparatus 11 includes an outer receptacle 17. The outer receptacle 17 includes a front wall 19, a rear wall 21, end walls 23 and a bottom 25 joined to one another in a liquid tight manner and has an open top 27. Reinforcing columns 28 may be provided on the walls 19, 21, 23 for strengthening the receptacle 17 as will now be apparent to those skilled in the art. The outer receptacle 17 preferably includes flanges 29 extending outwardly from the end walls 23. Spaced apertures 31 are preferably provided through the lower portions of the flanges 29 for use in fixedly attaching the outer receptacle 17 to the support structure 15. A threaded aperture 33 may be provided through the front wall 19 of the outer receptacle 17 adjacent the bottom 25 thereof, and a drain plug 35 may be provided for normally closing the aperture 33 while allowing the receptacle 17 to be drained if necessary. The outer receptacle 17 is preferably constructed of metal such as, for example, 0.0747 inch thick sheet steel, ASTM No. A569, having an ultimate tensile strength of 52,000 pounds per square inch and having a tensile yield strength of 38,000 pounds per square inch in any specific manner now apparent to those skilled in the art.

The apparatus 11 preferably includes an inner receptacle 37 for being positioned within the outer receptacle 17. The inner receptacle 37 includes a front wall 39, a rear wall 41, end walls 43 and a bottom 45 joined to one another in a liquid tight manner and has an open top 47. The inner receptacle 37 preferably includes one or more partition members 49 for dividing the inner receptacle 37 into a plurality of separate chambers with each of the chambers adapted to store one of the containers 13. The inner receptacle 37 is preferably constructed of metal in any specific manner now apparent to those skilled in the art. The inner receptacle 37 is preferably coated with a plastic material to protect the metal from the chemicals, etc.

The apparatus 11 includes a lid 53 movably attached to the outer receptacle 17 for movement between a closed position in which the open tops 27, 47 of the outer and inner receptacles 17, 37 are blocked or closed and an open position. The lid 53 preferably includes a plate-like body 55 having downturned edges 57. The lid 53 is preferably constructed of metal in any specific manner now apparent to those skilled in the art.

The apparatus 11 preferably includes hinge means 59 for movably attaching the lid 53 to the outer receptacle 17 and for allowing the lid 53 to move between the open position and the closed position. The hinge means 59 preferably includes an elongated shaft 61, attachment means 63 for attaching the shaft 61 to the rear wall 21 of the outer receptacle 17, and hinge plates 65 attached to the lid 53 and coupled to the shaft 61. The attachment means 63 may consist of metal lug members welded or otherwise fixedly attached to the rear wall 21 of the outer receptacle 17 with apertures therethrough for rotatably receiving the shaft 61.

The apparatus 11 includes lock means 67 coupled to the outer receptacle 17 for locking the lid 53 in the closed position. The lock means 67 includes a first hook member and a second hook member with one of the hook members attached to the lid 53 and with the other one of the hook members attached to the outer receptacle 17. The first hook member is movable between a locked position in which the second hook member is caught by the first hook member to lock the lid 53 in the closed position and an unlocked position. The first hook member preferably includes an elongated metal shaft 73 having at least one offset portion 75. Attachment means 77 are preferably provided for rotatably attaching the shaft 75 to the front wall 19 of the outer receptacle 17. The attachment means 77 may consist of metal lug members welded or otherwise fixedly attached to the front wall 19 of the outer receptacle 17 with apertures therethrough for rotatably receiving the shaft 73. Rotation of the shaft 73 will cause the first hook member to move between the locked and unlocked positions. The shaft 73 preferably includes a pair of spaced offset portions 75 and the second hook member preferably includes a hook plate 79 attached to the lid 53 for coacting with each offset portion 75 of the shaft 73. Each hook plate 79 may consist of a metal plate welded or otherwise fixedly attached to the lid 53 with a distal end portion extending downwardly from the lid 53 and bent to form a hook for engaging one of the offset portions 75 of the shaft 73 when the lid 53 is in the closed position and the shaft 73 is in the locked position.

The apparatus 11 preferably includes seal means 81 between the outer receptacle 17 and the lid 53 for forming a liquid-tight seal between the lid 53 and the outer receptacle 17 when the lid 53 is in the closed position and the first hook member of the lock means 67 is in the locked position. The seal means 81 preferably consist of an endless elastomer member fixedly attached by glue, or the like, to the undersurface of the lid 53 in a location for contacting the upper edges of the walls 19, 21, 23 of the outer receptacle 17 when the lid 53 is closed.

The apparatus 11 preferably includes bolt means 83 for coupling the outer receptacle 17 to the support structure 15. Each bolt means 83 preferably includes a backup or reinforcing plate 85 for being positioned under the support structure 15, a bolt member 87 for extending through one of the apertures 31 in a flange 29, the support structure 15 and one of the reinforcing plates 85, and a nut 89 for being attached to the bolt member 87 beneath the associated reinforcing plate 85. Each of the bolt means 83 additionally preferably includes a flat washer 91 for being positioned between the head of the associated bolt member 87 and the associated flange 29, and a lock washer 93 for being positioned between the associated nut 89 and the associated reinforcing plate 85. With the exception of the reinforcing plate 85, each bolt means 83 may consist of standard, off-the-shelf components now apparent to those skilled in the art. Each reinforcing plate 85 preferably consists of a 2.5 inch square of ¼ inch thick SAE 1045 HRS bar. A flat washer 91 with a 0.75 inch outer diameter is recommended. The nut 89 is preferably self-locking. Plated hardware should be used to minimize corrosion.

The apparatus 11 preferably includes outrigger attachment means 95 for allowing one of a container, such as a typical portable chemical sprayer 97, to be attached to the exterior of the outer receptacle 17. The outer receptacle 17 preferably includes at least one outrigger hook member 99 attached to one or both of the end walls 23 thereof. Each outrigger hook member 99 may consist simply of a metal web welded or otherwise fixedly attached to one of the end walls 23. The outrigger attachment means 95 preferably includes a body 101 having at least one hook member 103 for coacting with an outrigger hook member 99 to removably attached the outrigger attachment means 95 to the outer receptacle 17. The outrigger attachment means 95 preferably includes spring arm means 105 attached to the body 101 thereof for gripping the sprayer 97 and a bottom member 107 attached to the lower end of the body 101 thereof for supporting the sprayer 97.

Although the present invention has been described and illustrated with respect to a preferred embodiment and a preferred use therefor, it is not to be so limited since modifications and changes can be made therein which are within the full intended scope of the invention.

I claim:

1. An apparatus for safely storing one or more containers of harzardous liquids and the like; said apparatus comprising:

(a) a receptacle including a front wall, a rear wall, end walls and a bottom joined to one another in a liquid-tight manner and having an open top;

(b) a lid movably attached to said body for movement between a closed position in which said open top of said receptacle is blocked and an open position; and (c) lock means coupled to said receptacle for locking said lid in said closed position, said lock means including a first hook member and a second hook member with one of said hook members attached to said lid and with the other of said hook members attached to said receptacle, and first hook member being movable between a locked position in which said second hook member is caught by said first hook member to lock said lid in said closed position and an unlocked position.

2. The apparatus of claim 1 in which said first hook member includes an elongated shaft having at least one offset portion and in which is included attachment means for rotatably attaching said shaft to said front wall of said receptacle, rotation of said shaft causing said first hook member to move between said locked and unlocked positions.

3. The apparatus of claim 2 in which said first hook member includes a handle attached to said shaft for use in rotating said shaft.

4. The apparatus of claim 3 in which said shaft of said first hook member includes a pair of spaced offset portions and in which said second hook member includes a pair of hook plates attached to said lid, each of said hook plates coacting with one of said offset portions of said shaft of said first hook member.

5. The apparatus of claim 4 in which is included hinge means for movably attaching said lid to said receptacle and for allowing said lid to move between said open position and said closed position.

6. The apparatus of claim 5 in which said hinge means includes an elongated shaft, attachment means for attaching said shaft to aid rear wall of said receptacle, and one or more hinge plates attached to said lid and coupled to said shaft of said hinge means.

7. The apparatus of claim 6 in which said apparatus is supported by a support member, and in which said receptacle includes attachment structure for allowing said receptacle to be fixedly attached to said support member.

8. The apparatus of claim 7 in which said attachment structure includes flange members extending outward of said end walls of said receptacle and bolt means for coupling said flange members to said support member.

9. The apparatus of claim 8 in which each of said bolt means includes a reinforcing plate for being positioned under said support member.

10. The apparatus of claim 9 in which each of said bolt means includes a bolt member for extending through one of said flange members and said support member and one of said reinforcing plates, and a nut for being attached to said bolt member beneath said reinforcing plate.

11. The apparatus of claim 10 in which each of said bolt means includes a flat washer for being positioned between the head of said bolt member and said flange member, and a lock washer for being positioned between said nut and said reinforcing plate.

12. The apparatus of claim 2 in which is included outrigger attachment means for allowing one of said containers to be attached to the exterior of said receptacle.

13. The apparatus of claim 12 in which said receptacle includes at least one outrigger hook member attached to at least one of said end walls thereof, and in which said outrigger attachment means includes a body having at least one hook member for coacting with said outrigger hook member of said receptacle to removably attach said outrigger attachment means to said at least one of said end walls of said receptacle.

14. The apparatus of claim 13 in which said outrigger attachment includes spring arm means attached to said body thereof for gripping said one of said containers.

15. The apparatus of claim 14 in which said outrigger attachment has a bottom member attached to the lower end of said body thereof for supporting said one of said containers.

16. An apparatus for being fixedly attached to a support member of a vehicle and for safely storing one or more containers of harzardous liquids or the like; said apparatus comprising:

(a) an outer receptacle including a front wall, a rear wall, end walls and a bottom joined to one another in a liquid tight manner and having an open top;

(b) an inner receptacle including a front wall, a rear wall, end walls and a bottom joined to one another in a liquid tight manner and having an open top, said inner receptacle being positioned within said outer receptacle;

(c) a lid movably attached to said outer receptacle for movement between a closed position in which said open tops of said outer and inner receptacles are blocked and an open position; and (d) lock means coupled to said outer receptacle for locking said lid in said closed position, said lock means including a first hook member and a second hook member with one of said hook members attached to said lid and with the other of said hook members attached to said lid and with the other of said hook members attached to said outer receptacle, said first hook member being movable between a locked position in which said second hook member is caught by said first hook member to lock said lid in said closed position and an unlocked position.

17. The apparatus of claim 16 in which said first hook member includes an elongated shaft having at least one offset portion and in which is included attachment means for rotatably attaching said shaft to said front wall of said outer receptacle, rotation of said shaft causing said first hook member to move between said locked and unlocked positions.

18. The apparatus of claim 17 in which said shaft of said first hook member includes a pair of spaced offset portions and in which said second hook member includes a hook plate attached to said lid for coacting with each offset portion of said shaft of said first hook member.

19. The apparatus of claim 18 in which is included hinge means for movably attaching said lid to said outer receptacle and for allowing said lid to move between said open position and said closed position.

20. The apparatus of claim 16 in which said inner receptacle includes one or more partition members for dividing said inner receptacle into a pluralithy of separate chambers with each of said chambers adapted to store one of said containers.

21. The apparatus of claim 16 in which is included seal means between said outer receptacle and said lid for forming a liquid tight seal between said lid and said outer receptacle when said lid is in said closed position and said first hook member of said lock means is in said locked position.

* * * * *